US007205533B2

(12) United States Patent
Hingst

(10) Patent No.: US 7,205,533 B2
(45) Date of Patent: Apr. 17, 2007

(54) COOLING APPARATUS

(75) Inventor: Uwe Hingst, Oberteuringen (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 56 days.

(21) Appl. No.: 11/209,313

(22) Filed: Aug. 23, 2005

(65) Prior Publication Data

US 2007/0000260 A1 Jan. 4, 2007

(30) Foreign Application Priority Data

Sep. 2, 2004 (DE) ..... 10 2004 042 398

(51) Int. Cl.

| | |
|---|---|
| ***H01J 5/02*** | (2006.01) |
| ***F25B 41/00*** | (2006.01) |
| ***F28D 7/12*** | (2006.01) |
| ***F28D 7/02*** | (2006.01) |
| ***G05D 16/00*** | (2006.01) |
| ***G05D 23/00*** | (2006.01) |

(52) U.S. Cl. ..... 250/239; 62/210; 165/156; 165/163; 165/280; 165/293; 165/297

(58) Field of Classification Search ..... 250/239; 62/210; 165/156, 163, 280, 283, 293, 297
See application file for complete search history.

(56) References Cited

U.S. PATENT DOCUMENTS 5,150,579 A 9/1992 Hingst
5,382,797 A 1/1995 Kunimoto et al.
2006/0016586 A1* 1/2006 Nail ..... 165/163

FOREIGN PATENT DOCUMENTS

| | | |
|---|---|---|
| DE | 1 501 715 | 3/1966 |
| EP | 0 432 583 B1 | 10/1993 |
| EP | 0 447 861 B1 | 7/1994 |
| JP | 2002162125 A | 6/2002 |
| SU | 1134861 A1 | 1/1985 |

* cited by examiner

*Primary Examiner*—Akm Ullah
*Assistant Examiner*—Francis M LeGasse, Jr.
(74) *Attorney, Agent, or Firm*—Scully, Scott, Murphy & Presser, P.C.

(57) ABSTRACT

A cooling apparatus (10) for cooling a detector (52), the cooling apparatus including an inner and an outer countercurrent heat exchanger (12 and 14, respectively) for a first and a second gas in a thermally insulating housing (16), the inner countercurrent heat exchanger (12) being arranged within a sublength of the outer countercurrent heat exchanger (14), and the inner countercurrent heat exchanger (12) being spatially separated from the outer countercurrent heat exchanger (14) by an outer sleeve (18). In this apparatus, the outer sleeve (18) has a partition plate (32) between an expansion nozzle (28) for the first gas located at the end of the inner countercurrent heat exchanger (12) and the remaining part of the outer countercurrent heat exchanger (14).

6 Claims, 1 Drawing Sheet

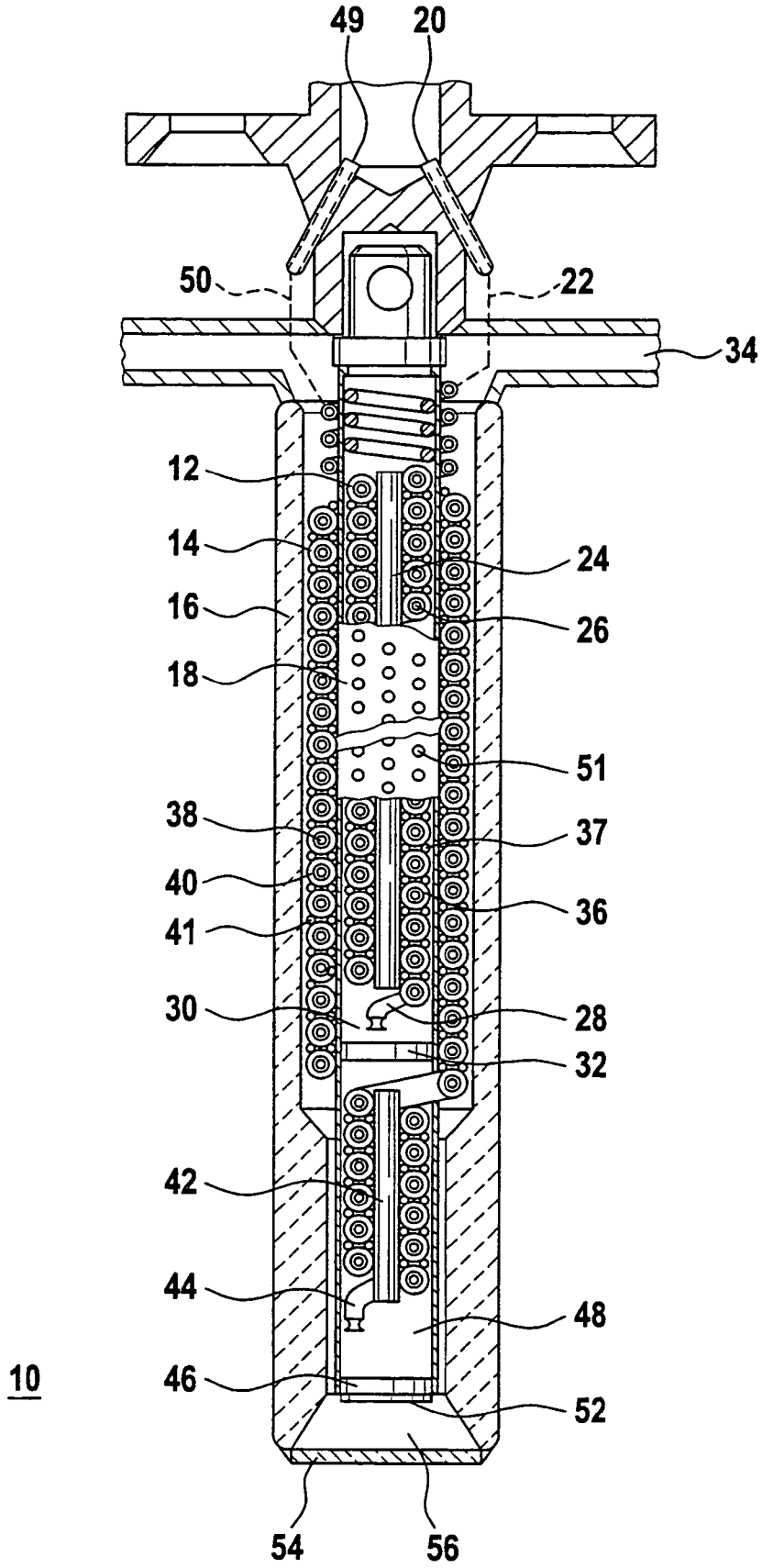
49
20
50
22
34
12
14
24
16
26
18
51
38
37
40
36
41
30
28
32
42
44
48
10
46
52
54
56

COOLING APPARATUS

BACKGROUND OF THE INVENTION

1. Field of the Invention

The invention relates to a cooling apparatus for a detector wherein the cooling apparatus includes an inner and an outer countercurrent heat exchanger for a first and second gas in a thermally insulating housing, whereby the inner countercurrent heat exchanger is arranged within a sublength of the outer countercurrent heat exchanger is spatially separated from the outer countercurrent heat exchanger by an outer sleeve.

Detectors, such as for example semiconductor detectors, only reach their optimum radiation sensitivity at temperatures well below room temperature. It is therefore necessary to cool the detectors.

2. Discussion of the Prior Art

EP 0 432 583 B1 has disclosed a cooling apparatus for cooling an object, the apparatus being composed of two series-connected coolers for two different gases. The first cooler for a first gas is a countercurrent heat exchanger which has an expansion nozzle located below the feed section of the second cooler for the second gas. The first gas is expanded at this expansion nozzle and thereby cooled. The first gas of the first cooler cools, in countercurrent, both the feed section of the second cooler for the second gas and its own feed section. Both coolers are arranged in a thermally insulating housing. The expansion nozzle of the second cooler is located outside this housing. The cooled gas which emerges there is used to cool objects located in the vicinity.

DE 1 501 715 has disclosed a device for liquefying gases which can be used, for example, to cool photocells. The device comprises two countercurrent heat exchangers in a Dewar flask. A countercurrent heat exchanger is arranged within the other countercurrent heat exchanger. The two countercurrent heat exchangers are separated from one another by an outer sleeve. A refrigeration chamber, in which the cooled gas of the inner countercurrent heat exchanger collects and, in countercurrent, cools its own feed section, adjoins the inner countercurrent heat exchanger, which is terminated by an expansion nozzle. The outer countercurrent heat exchanger, which is arranged around the outer sleeve in which the inner countercurrent heat exchanger and the refrigeration chamber are located, ends in an expansion nozzle, in the vicinity of which the object to be cooled is to be found. The gas which emerges through the expansion nozzle of the outer countercurrent heat exchanger cools both the object located in the vicinity of the expansion nozzle and its own feed section, in countercurrent.

Disadvantageously, the cooling capacity of the cooling apparatuses described is insufficient for certain applications, such as for example the rapid cooling of large-area detectors.

SUMMARY OF THE INVENTION

Therefore, the present invention is based on the problem of realizing a cooling apparatus for a detector which has a greater cooling capacity than that achieved in the prior art.

For a cooling apparatus for cooling a detector, the cooling apparatus including an inner and an outer countercurrent heat exchanger for a first and a second gas in a thermally insulating housing, the inner countercurrent heat exchanger being arranged within a sublength of the outer countercurrent heat exchanger, and the inner countercurrent heat exchanger being spatially separated from the outer countercurrent heat exchanger by an outer sleeve, according to the invention the object is achieved by virtue of the fact that a) the outer sleeve has a partition plate between an expansion nozzle for the first gas located at the end of the inner countercurrent heat exchanger and the remaining part of the outer countercurrent heat exchanger, b) the remaining part of the outer countercurrent heat exchanger, which projects beyond the inner countercurrent heat exchanger, is arranged within the outer sleeve, c) the outer sleeve is terminated by an end plate below an expansion nozzle for the second gas located at the end of the outer countercurrent heat exchanger, d) the outer sleeve has a number of apertures in the region in which it is surrounded by the outer countercurrent heat exchanger.

The invention is based on the consideration that an outer countercurrent heat exchanger for a second gas, as a result of the provision of an inner countercurrent heat exchanger which is spatially separated from the outer one by an outer sleeve, is subjected to a thermal load at the moment at which the second gas has been cooled to below the temperature of the first gas of the inner countercurrent heat exchanger. This reduces the maximum cooling capacity which can ultimately be realized.

Furthermore, the invention is based on the consideration that from this moment on, the longer the region in which the inner countercurrent heat exchanger and any refrigeration chamber located downstream of it and the outer countercurrent heat exchanger run together along the outer sleeve and exchange heat via the latter, the stronger the effect of the thermal load. The cooling capacity can be improved when the two countercurrent heat exchangers only both run along a certain sublength of the outer sleeve, and that part of the outer countercurrent heat exchanger which projects beyond the inner countercurrent heat exchanger is arranged within the outer sleeve. A further improvement to the cooling capacity can be achieved by virtue of a partition plate, which spatially separates the remaining part of the outer countercurrent heat exchanger from the inner countercurrent heat exchanger, being provided in the outer sleeve. The two measures listed above achieve a certain thermal decoupling between the inner countercurrent heat exchanger and the remaining part of the outer countercurrent heat exchanger, so that the inner countercurrent heat exchanger constitutes no thermal load or only a low thermal load for the outer countercurrent heat exchanger if the gas from the latter has already been cooled to below the temperature of the first gas of the inner countercurrent heat exchanger.

Furthermore, the invention is based on the consideration that the cooling apparatus reaches a high cooling capacity relatively quickly if the outer countercurrent heat exchanger is cooled in countercurrent not only by its own gas but also by a contribution from a further cooling gas. By virtue of the fact that the outer sleeve has a number of apertures in the region in which it is surrounded by the outer countercurrent heat exchanger, the outer countercurrent heat exchanger is cooled not only by its own gas in countercurrent, but also in part by the gas of the inner countercurrent heat exchanger. The gas of the inner countercurrent heat exchanger therefore cools its own feed section and, as a result of the gas passing through the apertures into the region in which the outer countercurrent heat exchanger is located, also cools this part of the feed section of the outer countercurrent heat exchanger.

Furthermore, the invention is based on the consideration that objects which are to be cooled, such as for example detectors, may be damaged, or at least functionally impaired—e.g. as a result of the surface of the object being covered with moisture—if they come into direct contact with a cooled or liquefied gas. Terminating the outer sleeve by an end plate below an expansion nozzle for the second gas located at the end of the outer countercurrent heat exchanger realizes a continuous cooling apparatus, composed of two countercurrent heat exchangers, which firstly no longer has to compensate for any external thermal loads and secondly does not produce any direct contact between gas and objects to be cooled.

The invention creates a cooling apparatus which, compared to the prior art, achieves faster cooling of a detector for a similar heat capacity or achieves a similar cooling time for larger detectors with a higher heat capacity.

Cooling apparatuses of this type are particularly suitable for use in missiles. Depending on the application area, missiles or their target detection units have to be fully operational, i.e. rapidly cooled, extremely quickly. Secondly, it is important for the missile to record the largest possible field of view for target detection and recognition. The size of the field of view which can be recorded is directly correlated with the surface area of the detector used in the missile. The larger the surface area of the detector which can be used as a function of the cooling capacity, the larger the field of view which can be recorded. Modern trends in target detection units are nowadays towards ever larger matrix detectors and therefore towards larger masses with corresponding heat capacities which have to be cooled by a cooling apparatus.

The fact that the inner countercurrent heat exchanger is arranged within the outer countercurrent heat exchanger results in an extremely compact design. It is precisely this very "slender" design of the cooling apparatus which makes it suitable for use in missiles, since in this case a cooling apparatus has to be accommodated in the region of the homing head of the missile, where space is extremely limited.

Certain military applications require not only cooling of a detector to a temperature below 100 K, but also that this temperature be reached particularly quickly. Extremely rapid cooling of this type, which should only amount to cooling times of one to two seconds with respect to a temperature of below 100 K, imposes high demands on a cooling apparatus.

The cooling capacity of a cooling apparatus is influenced not only by the structure of a cooling apparatus but also directly by the two gases used for cooling. For the second gas, it is expedient to select a gas which, in terms of its cooling capacity and its boiling point, satisfies the application-specific demands imposed with regard to the required cooling capacity and which can reach the minimum cooling temperature of the detector at which satisfactory operation of the latter is possible.

The gases argon, nitrogen or air are particularly recommended for cooling times in the range from one to two seconds and a cooling temperature of 100 K in accordance with the abovementioned military application, since in the case of all three of these gases the boiling point is below 100 K. By contrast, the first gas must have a boiling point above 100 K, but for effective cooling of the second gas must have a very high cooling capacity. The gases R14 (tetrafluoromethane, $CF_4$) or methane ($CH_4$) are recommended for the first gas.

On account of the high-pressure expansion at the expansion nozzle, the cooler the gases prior to the high-pressure expansion at the expansion nozzle, the higher the cooling capacity of the "second" gases. In the case of a cooling apparatus as described above, the first gas is partially also utilized for pre-cooling of the second gas in conjunction with the return section of the second gas. If a combination of the gases proposed above is selected, the second gas, which is used to cool the detector, is reduced to a temperature range which is well below the inversion temperature and is in the range just above its boiling point. In this temperature range, the second gas, in accordance with its thermodynamic properties, then has a significantly higher cooling capacity following its expansion compared to the cooling capacity which could be achieved by precooling only by the second gas. This allows virtually complete liquefaction of the second gas to be achieved. The detector can then be efficiently cooled by the liquid phase of the second gas. A particularly suitable combination of gases is presented, for example, by argon as second gas with a boiling point of 90 K and tetrafluoromethane as first gas with a boiling point of 140 K.

To reach cooling temperatures significantly below 90 K, it is recommended for the gas combination used to be a neon-argon or neon-nitrogen mixture as second gas for the outer countercurrent heat exchanger and methane with a boiling point of 113 K (at 1 bar) as first gas for the inner countercurrent heat exchanger.

The use of the gas R14 (tetrafluoromethane) for the inner countercurrent heat exchanger and of the gas argon for the outer countercurrent heat exchanger has proven a particularly suitable combination of gases for the cooling apparatus for missiles with an infrared detector. However, it is also conceivable for the gas methane ($CH_4$) to be used for the inner countercurrent heat exchanger and the gases nitrogen or air to be used for the outer countercurrent heat exchanger.

If the cooling apparatus is used in missiles, it is important for the weight which the missile has to carry with it as a result of the cooling apparatus and the quantities of gas which are required during a missile mission to be minimized. This can be achieved firstly by virtue of the fact that the flow rate of the first gas for the inner countercurrent heat exchanger can be reduced even to a zero quantity, depending on the temperature of the cooled second gas. This is because if the gas of the outer countercurrent heat exchanger has already been cooled to the desired temperature, it can keep itself at this temperature by means of its own countercurrent cooling, without the gas of the inner countercurrent heat exchanger continuing to be required for this purpose. It is expedient for the quantities of gas required for the inner and outer countercurrent heat exchangers to be determined as early as before use of the missile or even during development of the missile, rather than these quantities having to be carried in the missile as required. In practice, the cooling-gas tanks for the two gases for operation of the cooling apparatus are of correspondingly small dimensions and thereby make a contribution to saving space. The possibility of reducing the through-flow of gas for the inner countercurrent heat exchanger to a quantity of zero or fully consuming this gas after a certain operating time ensures that there is no overflow of liquid phase, leading to temperature stability problems, in the space downstream of the expansion nozzle of the outer countercurrent heat exchanger. Although this increases the cooling capacity required of the second gas for the outer countercurrent heat exchanger, since the cooling capacity which has to be dissipated is significantly reduced following the cooling phase for the second gas, the second gas can take over the higher cooling load resulting from the elimination of the cooling capacity from the cooling circuit by means of the first gas without problems. Specifically, this higher cooling load, as has already been mentioned above, also prevents the formation of an overflow of liquid phase of the second gas in the space downstream of the expansion nozzle of the outer countercurrent heat exchanger. Consequently, temperature stability problems resulting from liquid components of the second gas in the return section of the outer countercurrent heat exchanger, with corresponding sudden changes in temperature, are substantially avoided.

In general, suitable volume dimensions which are dependent on the cooling gas combination, volumes, pressures used and the duration of action must be ensured for the spaces which are formed below the expansion nozzles of the two countercurrent heat exchangers. These "vapour spaces", as they are known, also have to be geometrically designed firstly to ensure an optimum cooling capacity and secondly also to prevent an overflow of liquid phase, which has an adverse effect on the thermal stability. In particular the vapour space of the inner countercurrent heat exchanger for receiving the gaseous and fluid components has to be geometrically designed such that firstly it ensures an optimum cooling capacity with respect to the detector and secondly substantially avoids a return flow of the liquid phase into the outer countercurrent heat exchanger, since this can lead to highly variable through-flows of gas there, which in turn cause pressure changes in the vapour space and therefore lead to changes in evaporation point and temperature along the boiling point curve of the second gas, which have a detrimental influence on the thermal stability of the detector.

It is expedient for the number of apertures in the outer sleeve to be formed by a regular perforation. This ensures particularly intimate mixing of the two cooling gases used and therefore a shorter cooling time and a higher cooling capacity. The mixed gas return comprising the first and second gases is directly influenced by the number and size of the holes formed by the perforation in the outer sleeve. It is expedient for the geometric design of the perforations to be selected as a function of the cooling gas combination used and the desired through-flow quantity.

It is preferable for a detector to be arranged on the outer side of the end plate, which terminates the outer sleeve. The end plate consists of a thermally conductive material and thereby allows optimum heat transfer between the liquefied gas which is present in the vapour space of the outer countercurrent heat exchanger and the detector without the latter coming into direct contact with the liquefied gas. The thermally conductive thermal plate results in a homogenous temperature distribution over the entire detector. This ensures that the detector operates without fault. Furthermore, this prevents the detector from suffering any damage through direct contact with the liquefied gas.

It is expedient for the thermally insulating housing of the cooling apparatus to be configured in such a way that the detector is freely exposed at the front, i.e. can "look forwards" at a predetermined angle of view. The thermally insulating housing may be a completely thermally insulating Dewar flask, in order to thermally insulate the cooling apparatus from the environment.

It is expedient for the thermally insulating housing of the cooling apparatus to be terminated at its lower end by a window which is radiation-transparent with respect to the detector. This results in a cooling apparatus which allows operation of a fixedly integrated detector within the cooling apparatus. Moreover, the housing with the window protects the detector from damage and external thermal influences.

Furthermore, it is advantageous for the space between the end plate and the window to be evacuated. The evacuation improves the thermal insulation with respect to any thermal influences from the outside. Since vacuum is a poor heat conductor, the cooling is concentrated on the detector and not released to the environment via the latter. This ensures fault-free operation of the detector with scarcely any influence from thermal noise. This is because, as a result, the cooling capacity to be realized by the cooling apparatus during the cooling operation is concentrated on the remaining dissipative routes to the detector and on the thermal heat capacity of the detector and its securing means.

Furthermore, it is advantageous for the countercurrent heat exchangers to comprise a tube which is provided with fins and around which plastic filaments are drawn. The plastic filaments, like the fins, serve to further improve the heat transfer through diversion of gases. The resultant improvement in the heat transfer leads to shorter cooling times and therefore to the detector being ready for operation more quickly. Furthermore, it is in this way possible to improve the cooling capacity by reaching lower temperatures for the gas of the outer countercurrent heat exchanger. This also allows operation of detectors with a large surface area.

BRIEF DESCRIPTION OF THE DRAWINGS

An exemplary embodiment of the invention is explained in more detail with reference to a drawing. The FIGURE in the drawing diagrammatically depicts the structure of a cooling apparatus with an inner and an outer countercurrent heat exchanger.

DETAILED DESCRIPTION OF THE INVENTION

The cooling apparatus 10 has an inner countercurrent heat exchanger 12 and an outer countercurrent heat exchanger 14. The two countercurrent heat exchangers 12, 14 are arranged in a thermally insulating housing 16. The inner countercurrent heat exchanger 12, the outer countercurrent heat exchanger 14 and the housing 16 are positioned concentrically with respect to one another. The inner countercurrent heat exchanger 12 is spatially separated from the outer countercurrent heat exchanger 14 by a thin metallic outer sleeve 18.

A first high-pressure gas flows out of a pressure vessel (not shown) into the inner countercurrent heat exchanger 12 via a gas connection 20 and a feed line 22. The first high-pressure gas flows through a tube 26 arranged helically around an inner sleeve 24 of poor thermal conductivity until it reaches an expansion nozzle 28 located at the end of the tube 26. The first high-pressure gas is expanded at the expansion nozzle 28 and as a result is cooled in accordance with its Joule-Thomson heat coefficient. As a result, the feed section of the first high-pressure gas is gradually cooled further until a fluid comprising gaseous and liquid fractions is formed from the high-pressure gas downstream of the expansion nozzle. The liquid phase of the cooled high-pressure gas collects in a vapour space 30 which is located below the expansion nozzle 28 and is formed by a partition plate 32 located in the outer sleeve. The liquid, which evaporates there at the boiling point of the first high-pressure gas, then flows, together with the gaseous fraction which has not been liquefied, as a gas in countercurrent around the outer surface of the tube 26 and is discharged via an outlet 34. As a result, the tube 26 for the feed section of the first high-pressure gas and therefore the high-pressure gas itself are cooled to close to the boiling point of the first high-pressure gas by the cooling capacity of the first high-pressure gas. To improve the heat transfer between the gas feed section of the first high-pressure gas and the return section of the expanded, cooled first high-pressure gas, the tube 26 is provided with helical fins 36 on its outer side. In addition, plastic filaments 37 are drawn around the outer side of the tube to improve the heat transfer or heat exchange. The plastic filaments 37 lead to a turbulent flow in the return section of the expanded, cooled first high-pressure gas and thereby increase the heat exchange with the tube wall and the fins.

The outer countercurrent heat exchanger 14 likewise comprises a tube 38, which is provided with fins 40 and plastic filaments 41 at its outer side. The tube 38 of the outer countercurrent heat exchanger 14 has been wound helically around the outside of the outer sleeve 18 as far as the level of the partition plate 32. Thereafter, the outer countercurrent heat exchanger 14 is continued below the partition plate 32 within the outer sleeve 18.

The region of the outer countercurrent heat exchanger 14 which runs within the outer sleeve 18, like the inner countercurrent heat exchanger 12, is wound around an inner sleeve 42 of poor thermal conductivity. The tube 38 of the outer countercurrent heat exchanger 14 likewise ends in an expansion nozzle 44. Below the expansion nozzle there is arranged an end plate 46, which terminates the outer sleeve 18. As a result, a vapour space 48 is formed for the second high-pressure gas for the outer countercurrent heat exchanger 14.

The second high-pressure gas for the outer countercurrent heat exchanger 14 flows out of a pressure vessel (not shown) via a gas connection 49 and a feed line 50 into the outer countercurrent heat exchanger 14. The second high-pressure gas for the outer countercurrent heat exchanger 14 then flows through the tube 38 and is expanded at the end of the tube 38, at the expansion nozzle 44, and as a result cooled in accordance with its Joule-Thomson coefficient. The liquid phase of the second high-pressure gas collects at the bottom of the vapour space 48, where, by virtue of its evaporation enthalpy, it is used to cool the detector; at its boiling point it changes back into the gas phase, i.e. evaporates. From there, the cooled second high-pressure gas flows in countercurrent along the outer surfaces of the tube 38 and is released via the outlet 34.

By virtue of the fact that the outer sleeve 18 has a regular perforation 52 in the region in which the inner countercurrent heat exchanger 12 is surrounded by the outer countercurrent heat exchanger 14, part of the cooled first high-pressure gas of the inner countercurrent heat exchanger 12 passes via the outer sleeve 18 into the outer region of the outer countercurrent heat exchanger 14. This results in better and faster cooling of the feed section of the second high-pressure gas for the outer countercurrent heat exchanger 14 by the second high-pressure gas flowing in countercurrent and by part of the first high-pressure gas of the inner countercurrent heat exchanger 12 flowing in countercurrent. As a result, in this region a quantitatively larger gas mixture is formed from the two high-pressure gases, in countercurrent with respect to the outer countercurrent heat exchanger 14, ensuring particularly efficient cooling of the feed section of the second high-pressure gas. Starting from the boiling point of the second high-pressure gas, the feed section of the latter is pre-cooled from the vapour space 48 by its own expanded gas from the expansion nozzle 44 into the region of the countercurrent heat exchanger 14 from which the region of the inner countercurrent heat exchanger 12 with the perforated outer sleeve begins. From this region, the outer countercurrent heat exchanger 14 is cooled by the gas mixture comprising the two expanded, cooled high-pressure gases. Starting from the partition plate 32, the additional part-stream of the first high-pressure gas from the expansion nozzle 28, at the boiling point of this gas, cools the feed section of the second high-pressure gas particularly intensively and therefore quickly in the outer countercurrent heat exchanger 14 as a result of this higher overall gas throughput. The result is very rapid cooling of the second high-pressure gas for the detector cooling.

The end plate 46 which terminates the outer sleeve 18 is a material of good thermal conductivity. A detector 52 is arranged on the outer side of this end plate 46. The detector 52 is in direct heat exchange, via the thermally conductive material of the end plate 46, with the liquid phase of the second high-pressure gas of the outer countercurrent heat exchanger 14 which has collected in the vapour space 48.

The thermally insulating housing 16 of the cooling apparatus 10 is terminated at its base surface by a radiation-transparent window 54. The window 54 is arranged in such a way that it is located parallel to and at a certain distance from the detector 52, allowing the latter to record as large a field of view as possible. The space 56 which is formed by the thermally insulating housing 16, the window 54 and the end plate 46 is evacuated in order to prevent heat exchange between detector 52 and environment.

LIST OF DESIGNATIONS

10 Cooling apparatus
12 Inner countercurrent heat exchanger
14 Outer countercurrent heat exchanger
16 Thermally insulating housing
18 Outer sleeve
20 Gas connection
22 Feed line
24 Inner sleeve
26 Tube
28 Expansion nozzle
30 Vapour space
32 Partition plate
34 Outlet
36 Fins
37 Plastic filaments
38 Tube
40 Fins
41 Plastic filaments
42 Inner sleeve
44 Expansion nozzle
46 End plate
48 Vapour space
49 Gas connection
50 Feed line
51 Perforation
52 Detector
54 Window
56 Space

The invention claimed is:

1. Cooling apparatus (10) for cooling a detector (52), the cooling apparatus including an inner and an outer countercurrent heat exchanger (12 and 14, respectively) for a first and a second gas in a thermally insulating housing (16), the inner countercurrent heat exchanger (12) being arranged within a sublength of the outer countercurrent heat exchanger (14), and the inner countercurrent heat exchanger (12) being spatially separated from the outer countercurrent heat exchanger (14) by an outer sleeve (18), wherein a) the outer sleeve (18) has a partition plate (32) between an expansion nozzle (28) for the first gas located at the end of the inner countercurrent heat exchanger (12) and the remaining part of the outer countercurrent heat exchanger (14), b) the remaining part of the outer countercurrent heat exchanger (14), which projects beyond the inner countercurrent heat exchanger (12), is arranged within the outer sleeve (18), c) the outer sleeve (18) is terminated by an end plate (46) below an expansion nozzle (44) for the second gas located at the end of the outer countercurrent heat exchanger (14), d) the outer sleeve (18) has a number of apertures in the region in which it is surrounded by the outer countercurrent heat exchanger (14).

2. Cooling apparatus (10) according to claim 1, wherein the number of apertures is formed by a regular perforation (51).

3. Cooling apparatus (10) according to claim 1, wherein a detector (52) is arranged on the outer side of the end plate (46).

4. Cooling apparatus (10) according to claim 3, wherein the thermally insulating housing (16) is terminated at its lower end by a window (54) which is radiation-transparent with respect to the detector (52).

5. Cooling apparatus (10) according to claim 4, wherein the space (56) between the end plate (46) and the window (54) is evacuated.

6. Cooling apparatus (10) according to claim 1, wherein the countercurrent heat exchangers (12, 14) comprise a tube (26, 38) which is provided with fins (36, 40) and around which plastic filaments (37, 41) are drawn.

* * * * *